US009416671B2

(12) United States Patent
Johnston et al.

(10) Patent No.: US 9,416,671 B2
(45) Date of Patent: Aug. 16, 2016

(54) BIMETALLIC TURBINE SHROUD AND METHOD OF FABRICATING

(71) Applicant: GENERAL ELECTRIC COMPANY, Schenectady, NY (US)

(72) Inventors: Bill Damon Johnston, Easley, SC (US); Daniel Anthony Nowak, Spring, TX (US); Srikanth Chandrudu Kottilingam, Simpsonville, SC (US); Melbourne J Myers, Duncan, SC (US); Joe Timothy Nowak, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 828 days.

(21) Appl. No.: 13/645,092

(22) Filed: Oct. 4, 2012

(65) Prior Publication Data

US 2014/0099194 A1 Apr. 10, 2014

(51) Int. Cl.

| | |
|---|---|
| ***F01D 25/24*** | (2006.01) |
| ***F01D 9/02*** | (2006.01) |
| ***F01D 11/08*** | (2006.01) |

(52) U.S. Cl.

CPC *F01D 9/02* (2013.01); *F01D 11/08* (2013.01); *F05D 2230/232* (2013.01); *F05D 2240/11* (2013.01); *F05D 2300/171* (2013.01); *F05D 2300/175* (2013.01); *F05D 2300/176* (2013.01); *Y10T 29/49236* (2015.01)

(58) Field of Classification Search

CPC ..... F01D 9/02; F01D 11/08; F01D 9/04

See application file for complete search history.

(56) References Cited

U.S. PATENT DOCUMENTS

| | | | |
|---|---|---|---|
| 2,858,104 | A | 10/1958 | Kelk et al. |
| 5,178,514 | A | 1/1993 | Damiral |
| 5,240,518 | A | 8/1993 | Wortman et al. |
| 5,967,745 | A | 10/1999 | Tomita et al. |
| 6,379,528 | B1 | 4/2002 | Lee et al. |
| 6,932,566 | B2 | 8/2005 | Suzumura et al. |
| 7,117,983 | B2 | 10/2006 | Good et al. |

(Continued)

FOREIGN PATENT DOCUMENTS

| | | | |
|---|---|---|---|
| DE | 10306915 | A1 | 9/2004 |
| EP | 0192516 | B1 | 8/1986 |

(Continued)

OTHER PUBLICATIONS

Bowman, Randy; Superalloys: A Primer and History; May 8, 1999; http://www.tms.org/Meetings/Specialty/Superalloys2000/SuperalloysHistory.html.*

(Continued)

*Primary Examiner* — Craig Kim
*Assistant Examiner* — Jason Fountain
(74) *Attorney, Agent, or Firm* — McNees Wallace & Nurick LLC

(57) ABSTRACT

A bimetallic ring for use as a turbine shroud in a gas turbine engine. The bimetallic ring forms a sealing surface as a hot gas flow path boundary in the engine. The ring is comprised of two materials. The first material, a wrought, oxidation resistant metal alloy comprises a first portion, which is the hot gas flow path sealing surface. The second material, a low cost low alloy steel, comprises a second portion that may be at least a pair of supporting side plates. A dissimilar weld joint joins the sealing surface to the second portion, the at least pair of supporting side plates.

21 Claims, 5 Drawing Sheets

(56) References Cited

U.S. PATENT DOCUMENTS

| | | | | |
|---|---|---|---|---|
| 7,434,670 | B2 | 10/2008 | Good et al. | |
| 7,584,618 | B2 | 9/2009 | Amiot et al. | |
| 2004/0005216 | A1 | 1/2004 | Suzumura et al. | |
| 2005/0123785 | A1 | 6/2005 | Sahoo et al. | |
| 2005/0276690 | A1 | 12/2005 | Amiot et al. | |
| 2007/0009349 | A1 | 1/2007 | Ward, Jr. et al. | |
| 2009/0010755 | A1 | 1/2009 | Keller et al. | |
| 2009/0053045 | A1* | 2/2009 | Nowak et al. | 415/173.1 |
| 2009/0053050 | A1 | 2/2009 | Bruce et al. | |
| 2010/0015350 | A1 | 1/2010 | Allen | |
| 2010/0047061 | A1 | 2/2010 | Morrison | |
| 2011/0182720 | A1 | 7/2011 | Kojima et al. | |

FOREIGN PATENT DOCUMENTS

| | | | |
|---|---|---|---|
| EP | 0256790 | A2 | 2/1988 |
| EP | 0270785 | A2 | 6/1988 |
| EP | 0333129 | B1 | 9/1989 |
| EP | 0444483 | A1 | 9/1991 |
| EP | 0515130 | A1 | 11/1992 |
| EP | 0594290 | A1 | 4/1994 |
| EP | 1124039 | A1 | 8/2001 |
| EP | 1033477 | A3 | 5/2002 |
| EP | 1215005 | A2 | 6/2002 |
| EP | 1253294 | A2 | 10/2002 |
| EP | 1312761 | A1 | 5/2003 |
| EP | 1416063 | A1 | 5/2004 |
| EP | 1593814 | A1 | 11/2005 |
| EP | 1746255 | A2 | 1/2007 |
| EP | 1225305 | B1 | 4/2007 |
| EP | 1944474 | A2 | 7/2007 |
| EP | 2028343 | A2 | 2/2009 |
| EP | 2221454 | A1 | 8/2010 |
| EP | 2302174 | A2 | 3/2011 |
| EP | 2354276 | A1 | 8/2011 |
| EP | 1156188 | A2 | 11/2011 |

OTHER PUBLICATIONS

Haynes International; Haynes 6-B alloy; 2008; http://www.haynesintl.com/pdf/h3043.pdf.*

Punshon, C S; Reduced pressure electron beam welding in the power generation industry; Jun. 2004; http://www.twi-global.com/technical-knowledge/published-papers/reduced-pressure-electron-beam-welding-in-the-power-generation-industry/.*

Funderburk, Scott; Postweld Heat Treatment; 1998; Welding Innovation vol. XV, No. 2.*

Stanford University; The Jet Engine: A Historical Introduction; Mar. 16, 2004;http://cs.stanford.edu/people/eroberts/courses/ww2/projects/jet-airplanes/how.html.*

ASM Aerospace Specification Metals Inc; AISI Type 304 Stainless Steel; Feb. 5, 2008;http://asm.matweb.com/search/SpecificMaterial.asp?bassnum=MQ304A.*

Haynes International; Haynes 230 alloy; https://www.haynesintl.com/pdf/h3000.pdf.*

* cited by examiner

BIMETALLIC TURBINE SHROUD AND METHOD OF FABRICATING

BACKGROUND OF THE INVENTION

Field of the Invention

Gas turbine engines operate by burning fuel and extracting energy from the combusted fuel to generate power. Atmospheric air is drawn into the engine from the environment, where it is compressed in multiple stages to significantly higher pressure and higher temperature. A portion of the compressed air is then mixed with fuel and ignited in the combustor to produce high energy combustion gases. The high energy combustion gases then flow through the turbine section of the engine, which includes a plurality of turbine stages, each stage comprising turbine vanes and turbine blades mounted on a rotor. The high energy combustion gases create a harsh environment, causing oxidation, erosion and corrosion of downstream hardware. The turbine blades extract energy from the high energy combustion gases and turn the turbine shaft on which the rotor is mounted. The shaft may produce mechanical power or may directly generate electricity. A portion of the compressed air is also used to cool components of the turbine engine downstream of the compressor, such as combustor components, turbine components and exhaust components.

A turbine engine includes one or more turbine stage. Each turbine stage includes turbine blades extending outwardly from a turbine disk toward an outer surface, which outer surface is referred to herein as a turbine shroud. The first stage, which is the stage closest to the combustor section of the engine, generally extend the shortest distance in a radial direction away from the turbine disk toward the turbine shroud, and also experience the highest temperatures. In each succeeding stage, the turbine blades extend a greater distance in a radial direction away from the turbine disk and toward the turbine shroud, and experience slightly cooler temperatures as the hot gases of combustion expand as they move axially through the turbine engine.

The interface between the turbine blades and the turbine shroud in each turbine stage ideally form a seal, so that the blades can extract as much energy as possible from the flowing, hot gases. The interface between the blades and the shroud experience the hottest temperatures as the gas flows through a turbine stage. If there is a gap between the blades and the turbine shroud, hot gases can escape between the blades and the shroud, resulting in turbine inefficiency. Thus, it is imperative that any gap between the blades and the shroud be minimized if not eliminated. In addition, as the blades rotate at high speeds and high temperatures, the blades will grow from thermal expansion and also from creep, so that the blades tend to wear into the shrouds over a period of time, which assists in maintaining the seal.

Because the sealing surface of the shrouds experience high temperatures, from the hot, oxidative and corrosive combustion gases, as well as abrasion from the rotating blades, it is important to construct the shrouds from high temperature materials that are strong at elevated temperatures, that are corrosion resistant, oxidation resistant, and that also exhibit wear resistance. Depending upon the turbine engine design one or more of the stages may require a high temperature shroud surface that can survive the harsh conditions in the turbine stages.

Turbine shroud materials, particularly in the high pressure turbine stages closest to the combustor, are typically manufactured from materials that have the aforesaid material characteristics. Such materials are expensive and usually are superalloys, such as nickel-based superalloys, iron-based superalloys and cobalt-based superalloys. These shrouds have been constructed both as single pieces and as multi-piece shroud segments. The turbine shroud also includes supporting structure adjacent to its sealing surface which does not see temperatures as high as the sealing surface. These surfaces are out of the gas flow path and so are not constantly exposed to the hot corrosive combustion gases, but these support surfaces, being part of the shroud, also comprise superalloy material.

What is needed is a turbine shroud comprising a plurality of materials in which only the sealing surface comprises a superalloy, while support structure comprises materials that can withstand lower temperatures and lower oxidation and corrosion requirements experienced away from the hot flow path.

BRIEF DESCRIPTION OF THE INVENTION

A bimetallic ring for use as a turbine shroud in a gas turbine engine is set forth herein. The bimetallic ring forms a sealing surface as a hot gas flow path boundary in the engine. The ring is comprised of two materials. The first material comprises a first portion which is the hot gas flow path sealing surface. The second material comprises a second portion that may be at least a pair of supporting side plates. A dissimilar weld joint joins the sealing surface to the second portion, the at least pair of supporting side plates.

The first material forming the sealing surface further comprises a wrought, oxidation resistant metal alloy having survivability at the hot gas flow path temperatures as the hot gas impinges upon sealing surface. The second material, which is a different material from the first portion and which is out of the hot gas flow path, comprises a material that acts as structural load support for the ring at moderate temperatures. The dissimilar metal weld must be compatible with the first material and the second material. While the dissimilar metal weld is out of the gas flow path, it must provide structural load support at moderate temperatures.

A method for fabricating a bimetallic ring for use as a turbine shroud gas flow path sealing surface in a gas turbine engine is set forth herein. The method comprises the steps of providing a first material, which will form a boundary on which hot gases of combustion will impinge. Because the gases in the hot flow path are hot gases of combustion, the first material is an oxidation resistant metal alloy having survivability at hot gas flow path temperatures. The material is formed into a first portion having a preselected geometry The method also requires providing a second material. The second material does not experience gas impingement of hot flow path gases. The second material has sufficient strength to provide structural load support for the metallic ring at moderate temperatures. Moderate temperatures as used herein are temperatures away from the hot flow path that are lower than hot gas flow temperatures. The second material is formed into a second portion having a preselected geometry.

The process includes shaping the first material forming the first portion into its preselected geometry and shaping the second material forming the second portion, which may be at least a pair of second plates, into its preselected geometry. Each of the portions has about the same length. The portion is welded to the first portion using a dissimilar weld joint at a junction or joint formed between the second portion and the first portion to form a welded structure. The welded structure may be further worked as required to form an arcuate sealing surface with a pair of flanges, the flanges extending in a substantially transverse direction away from the arcuate sealing surface so that the flanges are not in contact with gases flowing in the hot gas path. The sealing surface has a predetermined radius, which will vary dependent upon engine design, larger engines have a larger radius than smaller engines, which will have a sharper radius of curvature.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

A gas shroud for use as a sealing surface in a gas turbine engine is set forth herein. The gas shroud interfaces with a rotating blade to form a gas seal. The gas shroud is a metallic ring extending 360° around an engine gas flow path and it may be a single unitary piece formed by forging or welding. Alternatively the gas shroud may be a plurality of arcuate shrouds circumscribing a portion of the circumference of the engine gas flow path, such that when assembled together, forms a metallic ring extending 360° around the engine flow path.

Figure 1:
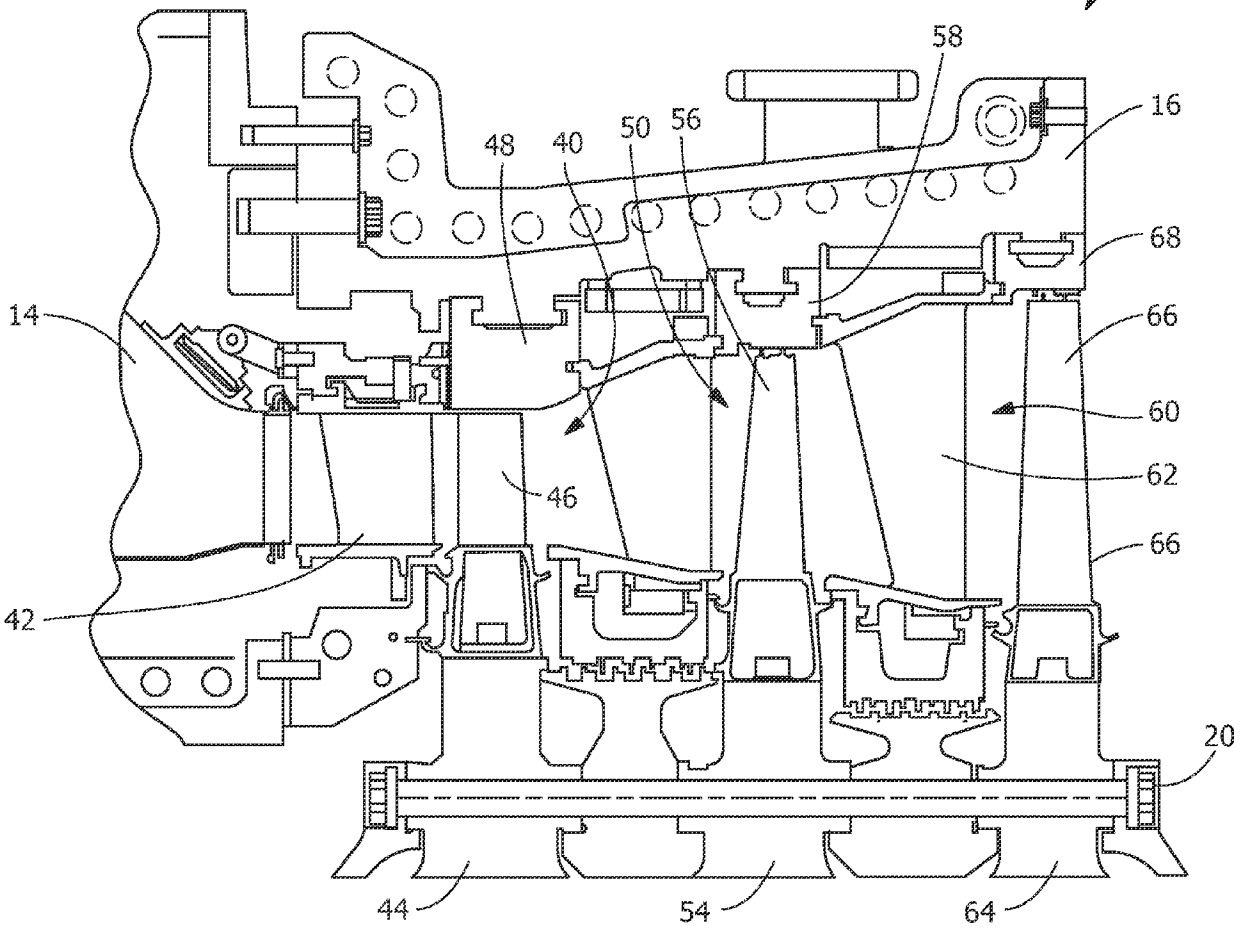
FIG. 1 is a cross sectional view of the hot gas flow path of a gas turbine engine.

Referring now to FIG. 1, which is a cross section of a hot gas path flow path 10 of a gas turbine engine, the engine cross-section between the combustors and the exhaust is depicted. Hot gas enters the turbine section 30 from the combustor section of the engine (not shown) through transition piece 14. For the gas turbine engine depicted in FIG. 1, turbine section comprises three turbine stages, stage 1 turbine 40, stage 2 turbine 50 and stage 3 turbine 60. The hot gas exiting transition piece 14 is redirected by stage 1 nozzle 42 to stage 1 rotating apparatus which further comprises a stage 1 turbine wheel 44 and a plurality of stage 1 turbine buckets or blades 46 attached to the periphery of turbine wheel 44 and extending radially outward from turbine wheel 44 into the flow of gas emanating from stage 1 nozzle 42. A stage 1 shroud segment 48 is positioned radially outward from the plurality of turbine blades 46, such that the gap between the plurality of blades 46 and shroud 48 is minimized. Each of subsequent stages, stage 2 turbine 50 and stage 3 turbine 60 is similarly arranged with the parts being like numbered.

Each of the turbine disks 44, 54 and 54 is mounted on a shaft 20. As hot gases of combustion exit each of stage 1 nozzle 42, stage 2 nozzle 52 and stage 3 nozzle 62, the hot gases striking turbine blades 46, 56, 66 causing precision balanced engine to rotate at high speeds. The hot gases of combustion will contact each of stage 1 shroud 48, stage 2 shroud 58 and stage 3 shroud 68 as the gas traverses turbine section 30 to engine exhaust (not shown) aft of stage 3 blades 66. If there are any gaps between the turbine blades and their respective shrouds, the gas will escape around the gaps, resulting in a loss of efficiency. Efforts are made to maintain the gaps at a minimum to maintain efficiency.

It will be understood by those skilled in the art that a gas turbine engine may have fewer stage or more stages than shown in FIG. 1, but each turbine stage has the same basic construction as depicted in FIG. 1 and described above. As can be seen from FIG. 1 each of stage 1 shroud 48, stage 2 shroud 58 and stage 3 shroud 68 have slightly different cross sectional configurations. Each of the shrouds is in contact with the hot gases of combustion traversing the engine, the surface of the shroud facing radially inward, forming a flow surface for the hot gases of combustion. Because the hot gases of combustion necessarily are at high temperatures, as high as 2300° F.-2400° F. as they exit the combustor, and 1800° F. as they exit turbine section 30 into the exhaust section, shrouds typically have been comprised of high temperature, oxidation resistant, corrosion resistant alloys, such as superalloys. These alloys are expensive.

Figure 2:
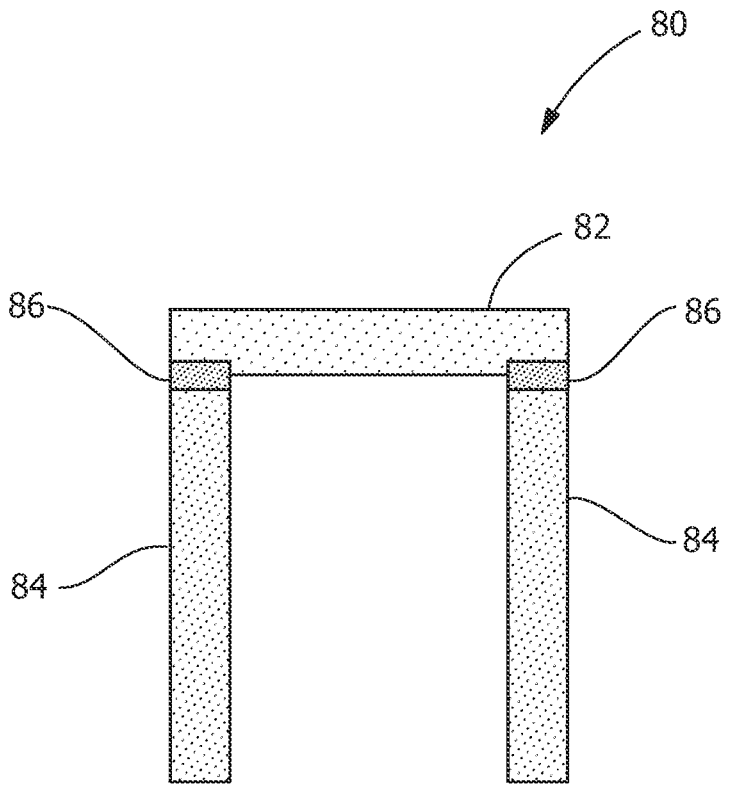
FIG. 2 is a cross-sectional view of an assembly of a generic shroud.

Even though each of the shrouds of the present invention have different configurations, each of the shrouds 48,58 and 68 include common elements. Referring now to FIG. 2, a generic cross sectional representation of a turbine shroud 80 is depicted, showing the improvements of the present invention. Shrouds include a top portion 82, a pair of side portions 84 and a dissimilar weld joint 86 joining the top portion 82 and the side portions 84 to form a welded structure. As can be seen from reference again to FIG. 1, each of stage 1 shroud 48, stage 2 shroud 58 and stage 3 shroud 68 include a top portion 82, and side portions 84, although each of the shrouds differ in configurational detail as to how the side portions attach each shroud to turbine case 16 as well as to details such as thickness of the sealing plate. Each of the configurational details of the shrouds remains, but the present invention enables the economical use of different materials for side portions 84 and top portion 82.

The welded structure can be formed into a shroud for use as stage 1 shroud 48, a stage 2 shroud 58, a stage 3 shroud 68 or any higher stage shroud as required by the engine design by any one of a number of processes. The shroud can be manufactured and formed into a single piece for installation into an engine. The top portion 82 can be formed of a high temperature superalloy such as a nickel-based superalloy, a cobalt-based superalloy, an iron-based superalloy and combinations thereof. While any high temperature superalloy may be used, preferred superalloys include high nickel content, high chromium content and include elements that enable γ' precipitation strengthening mechanisms, where γ' is a precipitate having an FCC crystal structure of the form $A_3B$, where A usually is Ni, Co and combinations thereof, and B is Al, Ti and combinations thereof. Those skilled in the art will recognize that γ' can be formed of other elements (A may include Cr, Mo, V for example), which depends on the overall composition of the alloy selected. Such preferred alloys include Haynes 230, HR-120, Haynes 188, Haynes 25 and INCO® 625. As should be obvious to those skilled in the art, the materials used top portion 82 in stage 1 shroud 48, stage 2, shroud 58 and stage 3 shroud 68 may be different superalloy materials, as the temperature of the hot gases of combustion decreases as the hot gases of combustion expand and move to the exhaust. Clearly, stage 1 shroud 48, which experiences the highest temperatures, must survive the harshest conditions. Top portion 82 can be provided as a wrought material that is rolled or forged, providing an advantage over cast shrouds. Wrought materials allow the grain structure to be controlled so at to take advantage of oriented grains. As an example, the grains in a wrought material can be controlled so that the grains are preferentially elongated in a circumferential direction when the top portion is installed as the sealing surface in the gas turbine engine. Elongation of grains in the circumferential direction improves the erosion resistance of the sealing surface. Although wrought materials are more expensive than cast materials, because the microstructure of a wrought material can be controlled to provide superior mechanical properties, top portion as a wrought material can be with a thinner section in the radial direction than a cast section, with the accompanying advantage of reduced weight.

Alternatively, instead of a single ring, top portion 82 may be fabricated as a plurality of shroud segments that can be joined to form a single ring. The shroud segments can be provided as wrought material, as discussed previously. The wrought material can be provided as a flat plate or the wrought material can be provided as an arcuate shape for subsequent processing.

A pair of side portions 82 can be formed of a moderate temperature material which is less expensive than the high temperature superalloy used to form top portion 82. Since the side portions are assembled to turbine case 16 and support the shroud in the engine, the side portions should have moderate strength at elevated temperatures. Referring again to FIG. 1, it can be seen that while each of shrouds 48, 58 and 68 will operate at elevated temperatures, by nature of being located in the turbine section 30 of a gas turbine engine, shrouds 48, 58 and 68 are not directly exposed to the hot gases of combustion emanating from the combustors and traversing the turbine portion. By comparison, the temperatures are moderate compared to the hot gases of combustion which may be as high as 2400° F. entering stage 1 turbine 40 and 1800° F. leaving stage 3 turbine 60. Although moderate is a relative term, it is a temperature that is lower than the temperature experience by the top portion 82 by 100-600° F., depending upon the cooling schemes employed to cool the shrouds. Alloys that may be used for side portions 84 include less expensive superalloys such as HR-160 and Haynes 6B, steels such as 300 series stainless steels and high strength low alloy (HSLA) steels such as chrome-moly steels. The selected alloys for this use must retain their strength at temperatures of operation and should not undergo phase transformations while operating for extended times at elevated temperatures. Side portions may be provided as cast materials or wrought material. Wrought material is more expensive, but provides the advantage of improved mechanical properties so that side portions 84 may be stronger as wrought sections than as cast sections, with the accompanying advantage of reduced weight sue to thinner sections. Each of side portions may be provided as a single ring that may be fit up over top portion 82. When top portion 82 is provided as a single ring, each of side portions 84 may be provided as a ring with an inner diameter that mate with each side of the outer diameter of top portion 82.

Alternatively, when, top portion 82 is fabricated as a plurality of shroud segments that can be joined to form a single ring, side portions also are fabricated as segments that can be joined to top portion 82. Side portions 84 can be provided as wrought material or as cast material, as discussed previously. However, each of side portions should have the same shape as top portion 82 and should be about the same length. When top portion 82 is provided as a flat plate, then side portions 84 should be provided as flat plates as well. When top portion 82 is provided as an arcuate shape, then side portions 84 should be provided as arcuate shapes so that side portions 84 are assembled over top portion 82 such that an inner concave surface of each top portion 84 will mate with opposite sides of outer surface (convex surface) of top portion 82.

Ideally, prior to assembly of side portions 84 to top portion 82, a weld preparation (prep) can be formed on the interfacing surfaces. Thus, for example, when the top portion 82 and side portions 84 are provided as arcuate shapes, a weld prep can be formed on the edges of each side of outer surface (convex surface) of top portion 82 and a weld prep can be formed on the inner concave surface of side portions 84.

Once side portions 84 are fit up to top portion 82, a full penetration weld may be formed to form a welded structure. While the top portion 82 and side portions 84 may be provided so that the weld joint may be made anywhere along the surfaces extending away from the sealing surfaces, top portion and side portions 84 are provided for any particular design to minimize the amount of material provided as top portion 82 in order to minimize expense while maintaining engineering requirements. Because the materials forming the top portion 82 and side portions 84 are different materials, the full penetration weld necessarily is a dissimilar metal weld. The dissimilar metal weld may be accomplished by any technique for full penetration dissimilar metal welds, including but not limited to electron beam welding (EBW), gas tungsten arc welding (GTAW) and gas metal arc welding (GMAW). Welding parameters will depend on the materials used for the top portion 82 and side portions 84. For example, when low alloy steels of grade 22 or grade 91 are utilized with EBW, the fill metal will usually be a shim of Hastelloy® W having a thickness of about 0.020-0.030 inches. When the welding is done using GTAW or GMAW, the filler metal will usually be INCO® 625, except when the base materials include low alloy steels of grade 22 or grade 91, in which case the filler metal will be Hastelloy® W or EPRI P87. However, once the materials are determined, the welding parameters for the dissimilar metal weld should be known to those skilled in the art.

Stress relief of the weld joint also well depend on the materials used for the top portion 82 and side portions 84. However, once the materials are determined, the stress relief heat treatment, if required, for the dissimilar metal weld should be known to those skilled in the art to relieve stresses in the weld and in the heat affected zone (HAZ). Depending upon the materials selected, the stress relief may be of the entire welded structure or it may be a localized stress relief affecting only the weld joint and the heat affected zone.

Figure 3:
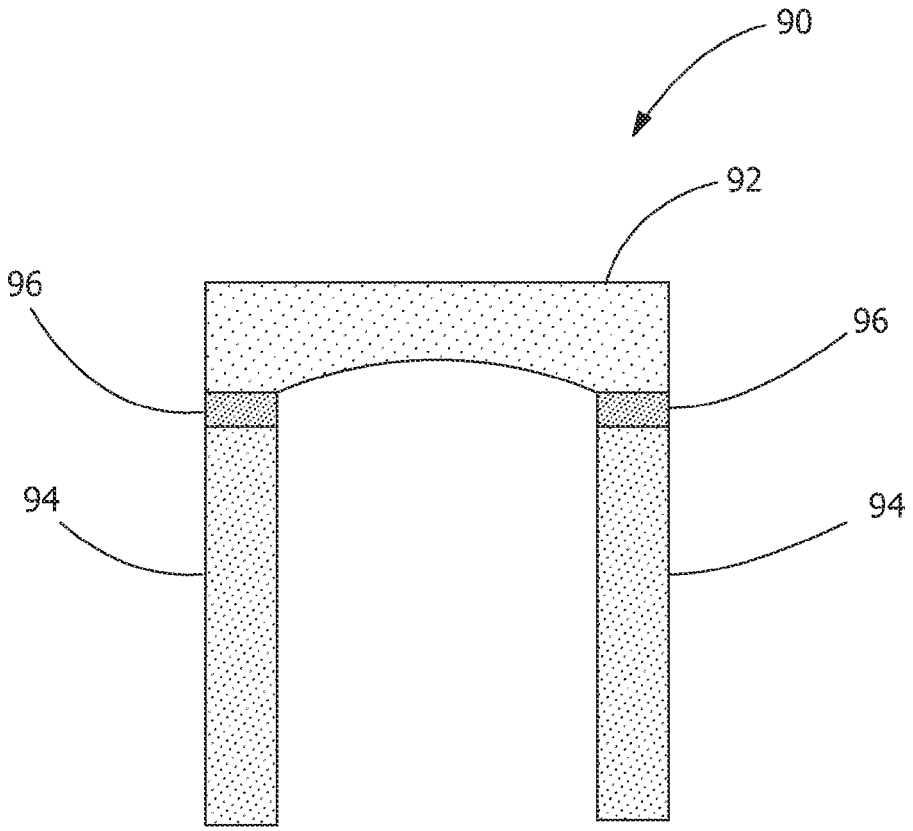
FIG. 3 is a cross-sectional view of a welded shroud structure in which the top portion has been rough machined prior to welding.

Each of top portion 82 and side portions 84 may be rough machined or final machined before welding. However, it is preferred that one or both of top portion and side portions 84 only be rough machined before welding. FIG. 3 depicts a structure wherein at least top plate 82 has been machined prior to welding, and the welded structure reflects the rough machining. Furthermore, when top portion 82 and side portions 84 and provided for fabrication into shrouds from flat plates, after welding and before any stress relief operations, the welded structures are bent into an arcuate shroud segment having a predetermined radius, a plurality of shroud segments being assembled to form a turbine shroud.

Preferably, after welding and weld stress relief if required, the γ' structure may be developed in the seal surface of turbine shroud, formerly the top portion 82. This γ' structure may be developed before weld stress relief, particularly if the stress relief operation is confined to a local stress relief of the weld and the HAZ, and it may also be developed after final machining. However, developing the γ' structure after final machining could result in distortion after the precipitation hardening heat treatment.

Figure 4:
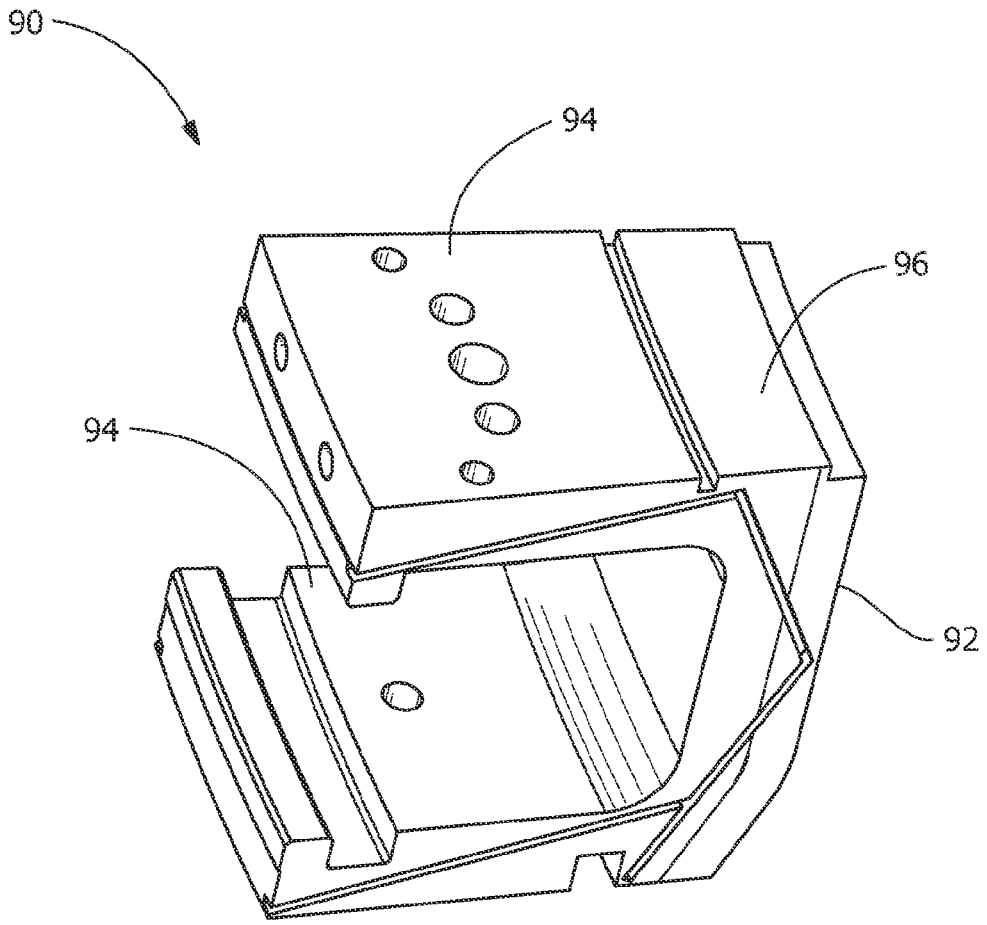
FIG. 4 is a perspective view of a welded shroud segment after final machining.

Final machining preferably is performed on the welded structure after all heat treatment operations. FIG. 4 is a perspective view of a welded shroud segment after final machining. Shroud segment 90 of FIG. 4 is one of 48 segments that is assembled to form a shroud for use in a gas turbine engine. Shroud segment 90, although final machined, includes in the welded, machined assembly all of the features described above, including side portions 94 welded to top portion 92, the weld joints being dissimilar metal welds 96.

Figure 5:
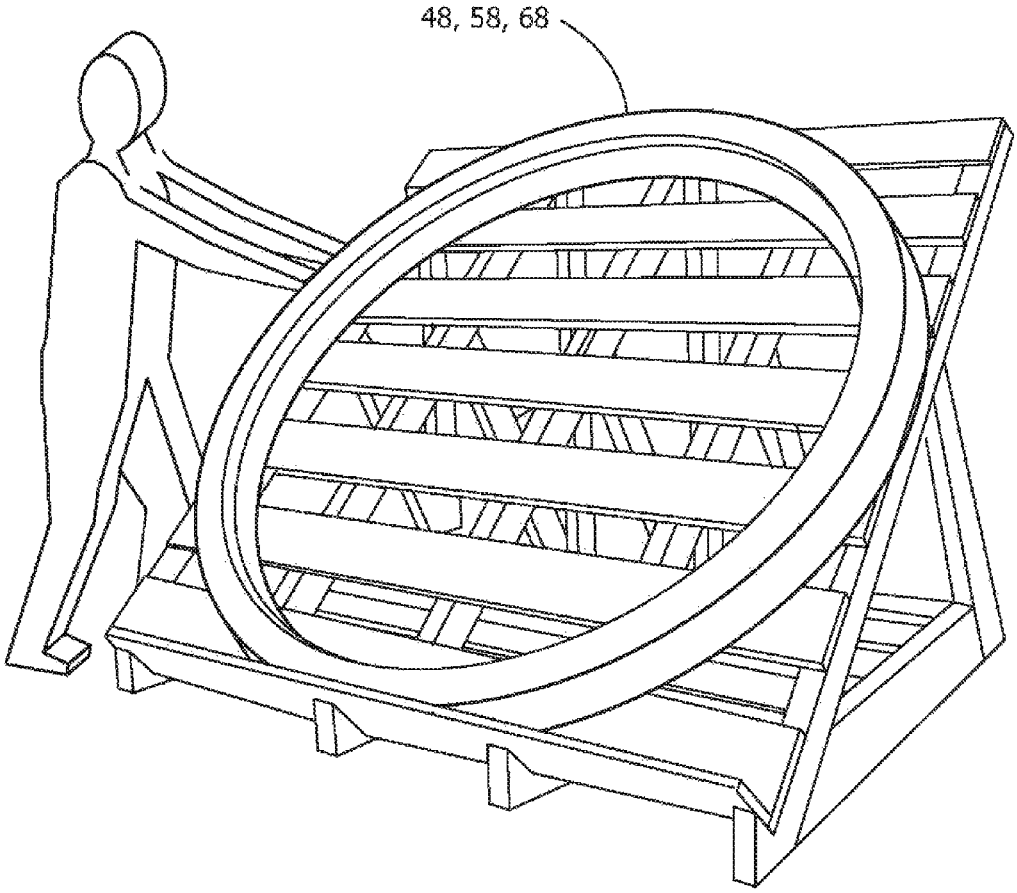
FIG. 5 is a view of a perspective view of a welded shroud ring, comprising a single top portion and single ring side portions welded to top portion.

FIG. 5 depicts a shroud for assembly into a gas turbine engine and demonstrates the size of a typical shroud. This shroud has an inside diameter of about 95 inches and an outside diameter of about 109 inches. This shroud demonstrates a fabricated assembly of a top portion 82 fabricated of a single ring with side portions 84 welded to the top portion 82. The sizes provided are meant to be exemplary and not limiting as the sizes will increase or decrease based on the overall size of the gas turbine engine.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A bimetallic ring for use as a turbine shroud in a gas turbine engine, comprising:

a top portion forming a sealing surface as a hot gas flow path boundary in the engine and forming a back surface opposite the sealing surface;

a first supporting side plate extending away from the top portion;

a second supporting side plate extending away from the top portion;

a first dissimilar weld joint joining the top portion to the first supporting side plate; and a second dissimilar weld joint joining the top portion to the second supporting side plate;

wherein the back surface of the top portion, a first interior surface of the first supporting side plate, and a second interior surface of the second supporting side plate define a cavity therebetween, the back surface of the top portion being exposed to the cavity;

wherein the top portion comprises a first material;

wherein the first supporting side plate and the second supporting side plate comprise a second material different from the first material;

wherein the first material further comprises a wrought, oxidation resistant metal alloy having survivability at hot gas flow path temperatures;

wherein the second material further comprises a material providing structural load support at moderate temperatures, moderate temperatures being lower than hot gas flow path temperatures; and wherein the first dissimilar weld joint and the second dissimilar weld joint are compatible with the first material and the second material and provide structural load support at moderate temperatures.

2. The bimetallic ring of claim 1 wherein the top portion extends 360° around a hot gas flow path of the engine, forming a gas seal with a rotating blade.

3. The bimetallic ring of claim 1 wherein the wrought, oxidation resistant metal alloy first material further comprises a high temperature superalloy.

4. The bimetallic ring of claim 3 wherein the high temperature superalloy is selected from the group consisting of nickel-based superalloys, iron-based superalloys, cobalt-based superalloys and combinations thereof.

5. The bimetallic ring of claim 4 wherein the high temperature superalloy is a precipitation strengthened nickel-based superalloy having high chromium content, formed using a precipitation strengthening mechanism including a γ' precipitate having a crystal structure of the form $A_3B$.

6. The bimetallic ring of claim 5 wherein the γ' precipitate having the crystal structure of the form $A_3B$ further comprises A selected from the group consisting of Ni, Co, Cr, Mo, V and combinations thereof and B selected from the group consisting of Al, Ti and combinations thereof.

7. The bimetallic ring of claim 1 wherein the first material comprises at least one alloy of the group of metal alloys consisting of Haynes 230, HR-120, Haynes 188, Haynes 25 and INCO® 625.

8. The bimetallic ring of claim 1 wherein the first material has a controlled grain structure.

9. The bimetallic ring of claim 8 wherein the controlled grain structure is controlled by forging or rolling.

10. The bimetallic ring of claim 1 wherein the top portion forms a flow surface for hot gases of combustion having temperatures as high as 2400° F.

11. The bimetallic ring of claim 1 wherein the second material has high strength at temperatures up to 2200° F. outside of a hot gas flow path.

12. The bimetallic ring of claim 11 wherein the second material comprises at least one material selected from the group of materials consisting of 300 series stainless steels, high strength low alloy steels and chrome-moly steels.

13. The bimetallic ring of claim 11 wherein the second material is one of HR-160 and Haynes 6B.

14. The bimetallic ring of claim 11 wherein the second material has a wrought grain structure.

15. The bimetallic ring of claim 11 wherein the second material has a cast grain structure.

16. A method of fabricating a bimetallic ring for use as a turbine shroud gas flow path sealing surface in a gas turbine engine, comprising the steps of:

providing a first material comprising an oxidation resistant metal alloy having survivability at hot gas flow path temperatures;

providing a second material having sufficient strength for structural load support at moderate temperatures, moderate temperatures being lower than hot gas flow temperatures;

shaping the first material into a top portion having a preselected top portion geometry comprising a sealing surface and a back surface opposite the sealing surface;

forming a first supporting side plate having a preselected first plate geometry from the second material;

forming a second supporting side plate having a preselected second plate geometry from the second material;

welding the top portion to the first supporting side plate to form a first dissimilar weld joint at a first junction of the top portion and the first supporting side plate;

welding the top portion to the second supporting side plate to form a second dissimilar weld joint at a second junction of the top portion and the second supporting side plate to form a welded structure, wherein the back surface of the top portion, a first interior surface of the first supporting side plate, and a second interior surface of the second supporting side plate define a cavity therebetween, the back surface of the top portion being exposed to the cavity; and working the welded structure to form an arcuate sealing surface from the sealing surface with the first supporting side plate and the second supporting side plate forming a pair of flanges extending in a substantially transverse direction away from the arcuate sealing surface, the arcuate sealing surface having a predetermined radius.

17. The method of claim 16 wherein the dissimilar weld joints are welded by a welding procedure selected from the group consisting of electron beam welding, gas metal arc welding and gas tungsten arc welding.

18. The method of claim 16 further including a stress relief heat treatment to relieve stresses in the dissimilar weld joints and in a heat affected zone adjacent the dissimilar weld joints formed by welding.

19. The method of claim 18 wherein the stress relief heat treatment is a local stress relief confined to the dissimilar weld joints and the heat affected zone.

20. The method of claim 16 wherein the step of providing the first material includes providing a precipitation strengthened nickel-based superalloy having high chromium content, formed using a precipitation strengthening mechanism including a γ' precipitate having a crystal structure of the form $A_3B$.

21. The method of claim 16 further including a precipitation hardening heat treatment to develop a γ' precipitate in the first material after welding.

* * * * *